US012643731B2

(12) United States Patent
Riley

(10) Patent No.: US 12,643,731 B2
(45) Date of Patent: Jun. 2, 2026

(54) DISPENSERS FOR SPRAYING CHEMICAL IRRITANTS AND METHODS OF USING

(71) Applicant: Security Equipment Corporation, Fenton, MO (US)

(72) Inventor: Louis F. Riley, Conway, AR (US)

( * ) Notice: Subject to any disclaimer, the term of this patent is extended or adjusted under 35 U.S.C. 154(b) by 258 days.

(21) Appl. No.: 18/678,232

(22) Filed: May 30, 2024

(65) Prior Publication Data

US 2025/0346423 A1 Nov. 13, 2025

Related U.S. Application Data

(60) Provisional application No. 63/646,166, filed on May 13, 2024.

(51) Int. Cl.
*B65D 83/384* (2025.01)
*F41H 9/10* (2006.01)

(52) U.S. Cl.
CPC ..... *B65D 83/384* (2013.01); *F41H 9/10* (2013.01)

(58) Field of Classification Search
CPC .... B65D 83/384; B65D 83/206; B65D 83/20; B65D 83/46; B65D 83/753; F41H 9/10
USPC ..... 222/183
See application file for complete search history.

(56) References Cited

U.S. PATENT DOCUMENTS 3,443,333 A 5/1969 Manatos
4,044,922 A 8/1977 Bordelon
4,220,263 A 9/1980 Caruso
4,301,947 A 11/1981 Potter
4,434,914 A 3/1984 Meshberg
4,454,966 A 6/1984 Hicks
4,477,005 A 10/1984 Martinez
4,667,851 A 5/1987 Wilkerson
5,088,121 A 2/1992 Wallace
(Continued)

FOREIGN PATENT DOCUMENTS

DE 102019001766 A1 9/2020
GB 2568870 6/2019
(Continued)

OTHER PUBLICATIONS

Guard Dog Light em Up—Self-Defense Combo w/Red Pepper Spray & Flashlight, Amazon Page, Dated Sep. 3, 2021(1 Page).

*Primary Examiner* — Paul R Durand
*Assistant Examiner* — Michael J. Melaragno
(74) *Attorney, Agent, or Firm* — Hartman Global IP Law; Gary M. Hartman; Domenica N. S. Hartman

(57) ABSTRACT

Dispensers for spraying a chemical irritant and methods of using dispensers. Such a dispenser includes a casing having an interior cavity and an access opening to the cavity. The interior cavity receives a cannister with a release valve oriented toward the access opening. An actuator is slidingly disposed in the access opening for actuating the release valve, and a retention mechanism releasably retains the actuator in the access opening. The retention mechanism includes a resilient leg and a radial shoulder extending radially inward from an interior wall of the interior cavity. The radial shoulder captures a foot of the resilient leg so as to inhibit removal of the actuator from the access opening. A wall of the actuator is operable to deflect the resilient leg radially inward to enable the foot to travel over and past the radial shoulder and allow the actuator to be removed through the access opening.

17 Claims, 3 Drawing Sheets

(56) References Cited

U.S. PATENT DOCUMENTS 5,287,995 A 2/1994 Redman et al.
5,310,086 A 5/1994 Julinot
5,348,193 A 9/1994 Bruckner et al.
5,392,975 A 2/1995 Blankenship, Jr.
5,420,766 A 5/1995 Hollis
D375,994 S 11/1996 Collins et al.
D376,766 S 12/1996 Cranford et al.
5,629,679 A 5/1997 Cranford et al.
5,644,297 A * 7/1997 Masi ..... F41H 9/10 340/691.7
5,683,168 A 11/1997 Teig et al.
5,875,945 A * 3/1999 Roach ..... F41H 9/10 294/149
5,893,483 A 4/1999 Duran
5,949,338 A 9/1999 Masi et al.
5,971,240 A 10/1999 Dequaine
5,988,450 A 11/1999 Cassarino
6,145,654 A 11/2000 Loghman
D435,081 S 12/2000 Hsu
6,196,419 B1 3/2001 Haney et al.
6,199,726 B1 3/2001 Cardwell, III et al.
D469,014 S 1/2003 Loghman-Adham et al.
D501,311 S 2/2005 Passmore
6,957,750 B1 10/2005 Trudell
6,981,616 B2 1/2006 Loghman-Adham et al.
7,121,432 B2 10/2006 Kostal et al.
7,121,434 B1 10/2006 Caruso
7,178,696 B2 2/2007 Larsen et al.
D555,838 S 11/2007 Robertson
D585,520 S 1/2009 Teig
D619,196 S 7/2010 Cardwell, III et al.
D636,050 S 4/2011 Kaufman
D642,376 S 8/2011 Pennington
D657,551 S 4/2012 Lynn
8,245,878 B2 8/2012 Smith et al.
8,310,360 B2 11/2012 Ross, Jr. et al.
8,313,009 B2 11/2012 Parisi et al.
D681,768 S 5/2013 Ross, Jr. et al.
8,499,974 B2 8/2013 Bennett
8,556,125 B2 10/2013 Dapper
D696,857 S 1/2014 Atteberry et al.
8,690,020 B1 4/2014 Murray
D712,502 S 9/2014 Olson
D713,922 S 9/2014 Sheikh et al.
8,935,940 B1 1/2015 Lough
D723,131 S 2/2015 Habermann et al.
8,985,397 B2 3/2015 Lord
D731,172 S 6/2015 Atteberry et al.
9,199,784 B2 12/2015 Caruso
9,216,853 B2 12/2015 Caruso
9,257,026 B2 2/2016 Kalina
9,267,767 B2 2/2016 Hwang
9,354,024 B1 5/2016 Perry
9,395,077 B2 7/2016 Flynn
9,423,208 B1 8/2016 Mahmalji
9,586,750 B1 3/2017 Mangold
9,605,930 B2 3/2017 Ben Yair et al.
9,691,244 B2 6/2017 Weng
9,715,805 B1 7/2017 Scully et al.
D800,446 S 10/2017 Sheikh et al.
9,815,612 B1 11/2017 Caruso
9,883,022 B2 1/2018 Barnes et al.
9,922,537 B2 3/2018 Shah et al.
9,927,213 B2 3/2018 Komperda
D818,076 S 5/2018 Sheikh
10,054,305 B1 8/2018 Slepack
D829,297 S 9/2018 Sheikh
10,139,101 B2 11/2018 Pires
10,144,563 B1 12/2018 Caruso
D838,337 S 1/2019 Frisk
10,175,032 B2 1/2019 Cooper
10,197,358 B2 2/2019 Hebden et al.
10,230,827 B2 3/2019 DiPerna et al.
10,247,524 B1 4/2019 Caruso
10,254,077 B2 4/2019 Crandall
10,309,753 B2 6/2019 Forsythe et al.
10,429,153 B2 10/2019 Gorham
10,479,592 B1 11/2019 Caruso
10,502,519 B2 12/2019 Stilson
10,520,282 B2 12/2019 Nangunoori
10,634,460 B1 4/2020 Sheikh
D887,520 S 6/2020 Nance et al.
D890,287 S 7/2020 Hymowitz
D892,628 S 8/2020 Caruso
10,731,845 B2 8/2020 Harvey
10,921,097 B1 2/2021 Rojas
10,996,028 B2 5/2021 Jimenez
11,022,406 B2 6/2021 Rice
11,071,364 B1 7/2021 Fowler
D941,951 S 1/2022 Crilley
11,287,225 B2 3/2022 Bogacz et al.
11,320,233 B2 5/2022 Clemons et al.
11,402,179 B2 8/2022 Nance et al.
11,413,478 B2 8/2022 Bina et al.
11,478,229 B1 * 10/2022 Casali ..... F21S 10/06
11,519,700 B2 12/2022 Clemons et al.
11,573,067 B1 2/2023 Faircloth, Jr.
2011/0210146 A1 * 9/2011 Dapper ..... F41H 9/10 222/113
2011/0288680 A1 11/2011 Samain et al.
2013/0105518 A1 5/2013 McPherson et al.
2013/0112771 A1 5/2013 Ki et al.
2015/0069082 A1 3/2015 Breeden
2015/0312399 A1 10/2015 Teig
2015/0327092 A1 11/2015 Martch
2017/0087576 A1 3/2017 Fang et al.
2018/0087769 A1 3/2018 Pires
2023/0312222 A1 * 10/2023 Medved ..... B65D 83/384 222/394
2024/0124215 A1 * 4/2024 Riley ..... B65D 83/20
2024/0367888 A1 * 11/2024 Nance ..... B65D 83/20
2025/0073736 A1 * 3/2025 Riley ..... B05B 15/63
2025/0100782 A1 * 3/2025 Sprouse, II ..... F41H 9/10
2025/0273188 A1 * 8/2025 Sprouse, II ..... G10K 9/20
2025/0346423 A1 * 11/2025 Riley ..... B65D 83/22

FOREIGN PATENT DOCUMENTS

WO 9731218 8/1997
WO 2011045468 4/2011
WO 2019119103 6/2019

* cited by examiner

DISPENSERS FOR SPRAYING CHEMICAL IRRITANTS AND METHODS OF USING

CROSS-REFERENCE TO RELATED APPLICATIONS

This application claims the benefit of U.S. Provisional Application No. 63/646,166 filed May 13, 2024, the contents of which are incorporated herein by reference.

BACKGROUND OF THE INVENTION

The invention generally relates to dispensers for spraying chemical irritants, such as a dispenser, and methods of using dispensers.

Dispensers adapted to dispense a repellent, such as a pepper gel, mace, pepper spray, or other chemical irritant (hereinafter sometimes referred to as pepper spray as a matter of convenience) are prevalent personal safety devices. In conventional dispensers, a cannister containing the chemical irritant is housed within an outer body (casing) of the dispenser and the chemical irritant is dispensed (e.g., sprayed or otherwise released) from the cannister by operating an actuator (often a button or other operable member) disposed at what may be referred to as an upper end of the casing. The casing may be configured so that the cannister is inserted and/or removed through what may be referred to as a lower end of the casing (e.g., the end opposite the actuator). Alternatively, the casing may be configured so that the cannister is inserted and/or removed through the upper end of the casing where the actuator is located. However, in the latter configuration the cannister may not be secured in the casing and instead float freely in the casing, such that if the dispenser is turned upside down it is possible for the canister to fall out of the casing.

Therefore, it would be desirable if repellent dispensers that are configured so that a cannister containing a repellent is inserted and removed through the upper end of the dispenser were equipped with a mechanism to releasably retain the cannister within the dispenser and prevent the cannister from accidentally falling out of the dispenser.

BRIEF SUMMARY OF THE INVENTION

The intent of this section of the specification is to briefly indicate the nature and substance of the invention, as opposed to an exhaustive statement of all subject matter and aspects of the invention. Therefore, while this section identifies subject matter recited in the claims, additional subject matter and aspects relating to the invention are set forth in other sections of the specification, particularly the detailed description, as well as any drawings.

The present invention provides, but is not limited to, dispensers for spraying a chemical irritant and methods of using dispensers.

According to a nonlimiting aspect, a dispenser includes a casing having an upper end and a lower end disposed on a longitudinal axis of the casing. The casing has an interior cavity between the upper and lower ends and an access opening to the interior cavity disposed at the upper end of the casing. The interior cavity is configured to receive a cannister with a product release valve oriented toward the access opening in an operative configuration. The dispenser includes an actuator slidingly disposed in the access opening for actuating the product release valve, and a retention mechanism for releasably retaining the actuator in the access opening. The retention mechanism includes a top wall and a sidewall of the actuator, a resilient leg axially extending from the sidewall and having a foot extending radially outward from the resilient leg, and a radial shoulder extending radially inward from an interior wall of the interior cavity. The radial shoulder captures the foot of the resilient leg so as to inhibit removal of the actuator from the access opening of the casing. The top wall of the actuator is operable to be deflected so as to cause the resilient leg to sufficiently deflect radially inward to enable the foot to travel over and past the radial shoulder and thereby allow the actuator to slide out through the access opening.

Optionally, the dispenser may include a slit recessed into an exterior of the actuator. The slit is operable to deflect the top wall of the actuator by engaging the slit with a thumbnail or fingernail.

According to still another nonlimiting aspect, a method of removing a cannister from the dispenser includes deflecting the top wall of the actuator to cause the resilient leg to sufficiently deflect radially inward to enable the foot to travel over and past the radial shoulder, and then removing the actuator through the access opening and sliding the cannister out of the interior cavity through the access opening.

Technical aspects of dispensers and methods as described above preferably include the ability to insert and remove a cannister from an interior cavity of the dispenser through an upper end of the dispenser while positively securing the cannister within the interior cavity.

These and other aspects, arrangements, features, and/or technical effects will become apparent upon detailed inspection of the figures and the following description.

DETAILED DESCRIPTION OF THE INVENTION

Figure 1:
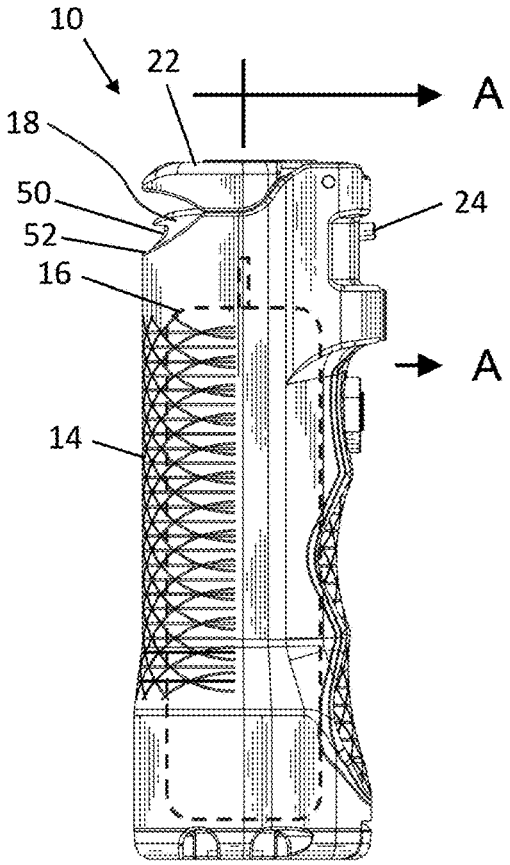
FIG. 1 is a side view of a dispenser for spraying a chemical irritant according to a nonlimiting embodiment of the invention.

The intended purpose of the following detailed description of the invention and the phraseology and terminology employed therein is to describe what is shown in the drawings, which include the depiction of one or more nonlimiting embodiments of the invention, and to describe certain but not all aspects of what is depicted in the drawings, including the embodiment(s) to which the drawings relate. The following detailed description also identifies certain but not all alternatives of the embodiment(s) depicted in the drawings. As nonlimiting examples, the invention encompasses additional or alternative embodiments in which one or more features or aspects shown and/or described as part of a particular embodiment could be eliminated, and also encompasses additional or alternative embodiments that combine two or more features or aspects shown and/or described as part of different embodiments. Therefore, the appended claims, and not the detailed description, are intended to particularly point out subject matter regarded to be aspects of the invention, including certain but not necessarily all of the aspects and alternatives described in the detailed description.

Although the invention will be described hereinafter in reference to a dispenser 10 shown in the drawings, it will be appreciated that the teachings of the invention are more generally applicable to a variety of types of personal protective devices adapted to discharge a chemical irritant, for example as a spray stream, to ward off a perceived attacker, such as, but not limited to, dispensers configured to spray mace, pepper gel, or other sprayable chemical irritant.

To facilitate the description provided below of the embodiment(s) represented in the drawings, relative terms, including but not limited to, "proximal," "distal," "anterior," "posterior," "vertical," "horizontal," "lateral," "front," "rear," "side," "forward," "rearward," "top," "bottom," "upper," "lower," "above," "below," "right," "left," etc., may be used in reference to the orientation of the dispenser 10 during its use and/or as represented in the drawings. All such relative terms are useful to describe the illustrated embodiment(s) but should not be otherwise interpreted as limiting the scope of the invention.

As used herein the terms "a" and "an" to introduce a feature are used as open-ended, inclusive terms to refer to at least one, or one or more of the features, and are not limited to only one such feature unless otherwise expressly indicated. Similarly, use of the term "the" in reference to a feature previously introduced using the term "a" or "an" does not thereafter limit the feature to only a single instance of such feature unless otherwise expressly indicated.

Figure 4:
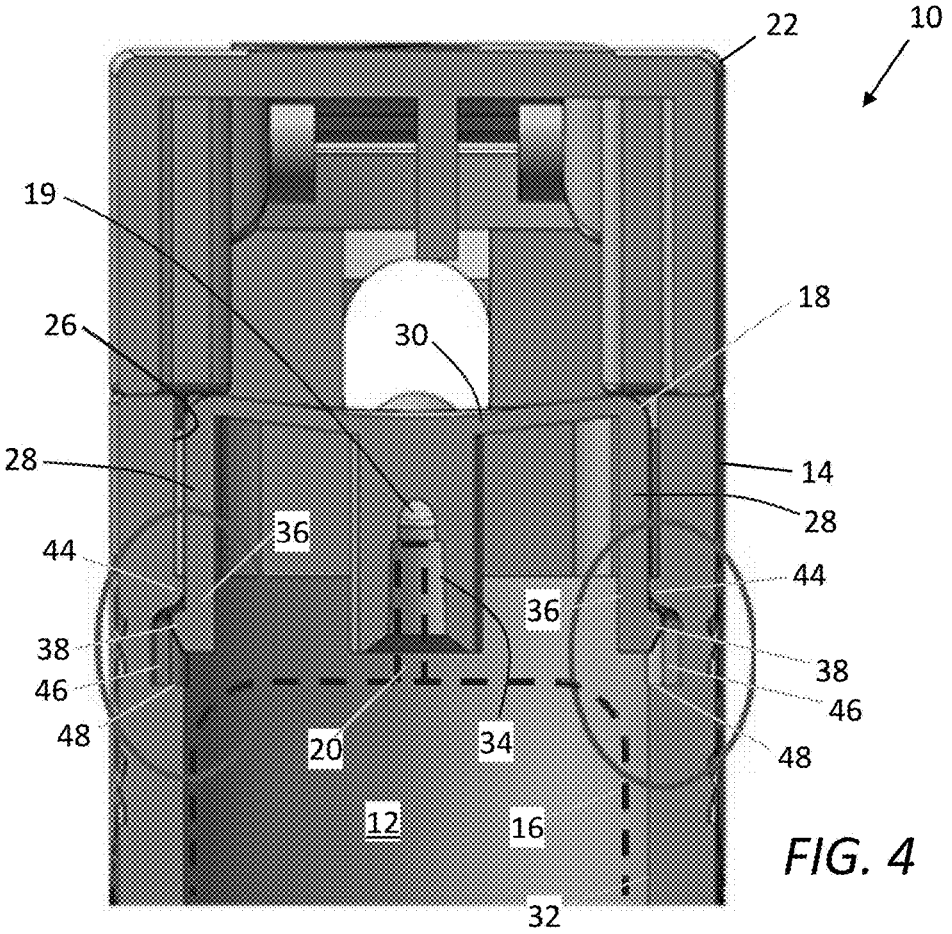
FIG. 4 is an enlarged partial axial cross-sectional view of the upper end of the dispenser along the lines A-A in FIG. 1, and depicts a cannister within an internal cavity of the dispenser.

Turning now to the nonlimiting embodiment represented in the drawings, the dispenser 10 is represented as configured for releasing a chemical irritant, such as a pepper spray, pepper spray gel, and/or mace from a cannister 16 disposed in an interior cavity 12 within a casing 14 of the dispenser 10. The dispenser 10 and canister 16 are configured so that the canister 16 can be separately provided and inserted into the casing 14 for operation. The dispenser 10 includes an actuator 18, represented as a button, which as represented in FIG. 4 is disposed at an upper end of the casing 14 and is adapted to actuate a product release valve 20 of the cannister 16. The dispenser 10 is equipped with a flip-up safety top 22 disposed over/above the actuator 18 to prevent unintended activation and discharge of product from the canister 16. As discussed below, the actuator 18 is releasably secured to the casing 14 to enable removal of the cannister 16 through the upper end of the casing 14. This arrangement is in contrast with pepper spray dispensers configured so that a cannister is inserted and removed through the lower end of their casings (e.g., the end opposite their actuators).

Figure 2:
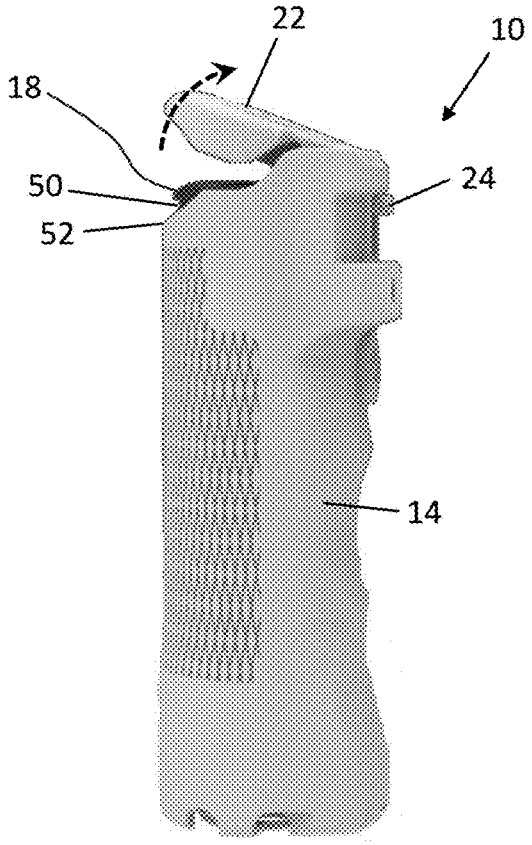
FIG. 2 is an isometric view of the dispenser of FIG. 1.

The casing 14 has a generally elongate shape extending from the upper end to an oppositely-disposed lower end of the casing 14. The upper and lower ends of the casing 14 are shown as disposed on a longitudinal axis of the casing 14. The interior cavity 12 extends axially within the casing 14 between the upper and lower ends for receiving and holding the cannister 16. The cannister 16 is secured in the interior cavity 12 of the casing 14 by the actuator 18. As noted above, the actuator 18 is configured to be depressed to activate the product release valve 20 at the upper end of the canister 16 when the canister 16 is operatively positioned in the interior cavity 12 of the casing 14. The product release valve 20 may be standard aerosol valve, a pump valve, or other valve mechanism that actuates to release the product from the cannister 16 when depressed axially. When pushed downwardly toward the product release valve 20, the actuator 18 opens the product release valve 20 and directs a spray (e.g., a stream) of product released from inside the canister 16 through a valve stem of the release valve 20 and then radially outwardly through a spray orifice 24 of the casing 14. To use the dispenser 10, for example, to spray a stream of pepper spray toward an attacker, a user grips the casing 14 in his/her hand, points the spray orifice 24 toward the intended target, flips the flip-top safety 22 upwardly (FIG. 2), and depresses the actuator 18 downwardly. The actuator 18 then depresses the product release valve 20, which releases the product through an internal passage 19 within the actuator 18 and out through the spray orifice 24 toward the intended target.

Figure 3:
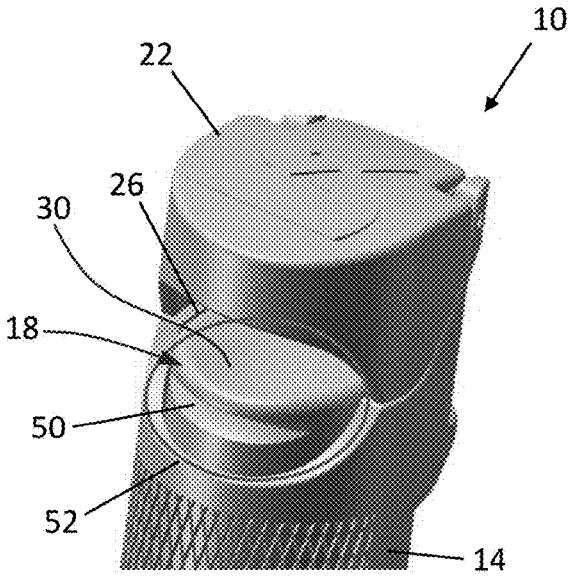
FIG. 3 is an enlarged isometric partial view showing details of an actuator and a flip-top safety at an upper end of the dispenser of FIG. 1.

As best seen in FIGS. 3 and 4, the actuator 18 covers the upper end of the cannister 16 and is slidably seated within an opening 26 that is located at the upper end of the casing 14 and provides access to the interior cavity 12, such that the opening 26 is referred to herein as the access opening 26. The actuator 18 has a generally cylindrical sidewall 28 and a top wall 30 adjoining the sidewall 28. The sidewall 28 in this example has a generally oval cross-section that matches the shape of an interior wall 32 of the casing 14 at the upper end of the interior cavity 12, though other shapes are foreseeable. The side wall 28 is shaped and sized to fit relatively closely within the interior wall 32 of the casing 14 at the upper end of the interior cavity 12 so that the actuator 18 can slide axially (up and down in the drawings) within the interior cavity 12. A receiver socket 34 extends axially downwardly from the underside of the top wall 30 to receive the valve stem of the product release valve 20, and the internal passage 19 within the actuator 18 extends from the receiver socket 34 to the spray orifice 24 to direct product form the release valve 20 out through the spray orifice 24.

Figure 5:
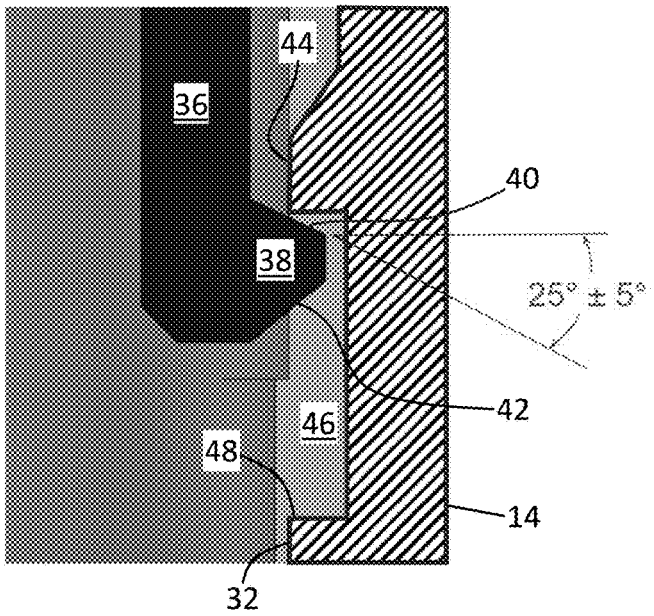
FIG. 5 is an enlarged view of the circled portion in FIG. 4 of a releasable retention mechanism for the actuator.

As best seen in FIGS. 4 and 5, to releasably retain the actuator 18 in the operative position in the opening 26 to the cavity 12, at least one and preferably two or more resilient retention legs 36 extend axially downwardly from the sidewall 28 of the actuator 18. In the example shown, two such retention legs 36 are shown as disposed on diametrically opposite sides of the side wall 28. Each retention leg 36 includes a foot 38 that projects radially outwardly from or adjacent the lower end of the retention leg 36 to form a snap retention member. Each foot 38 has a tapered upper surface 40 and a tapered lower surface 42. As indicated in FIG. 5, the upper surface 40 is preferably tapered so as to define a slope angle of about 20° to about 30° downwardly from a radial plane of the casing 14 that is oriented perpendicular to the longitudinal axis (axial direction) of the casing 14 (i.e., the upper surface 40 is inclined about 110° to about 120° from the axial direction of the casing 14). In one embodiment, the upper surface 40 has an angular slope of about 25° from the radial plane. The lower surface 42 may be tapered to slope at a larger angle to the radial plane that is the upper surface 40, for example, upwardly at a slope angle of about 20° to about 70° relative to the radial plane. Each foot 38 engages a radial shoulder 44 that projects radially inwardly from the radially interior surface of the interior wall 32 of the casing 14. Each foot 38 may be individually aligned with an individual radial shoulder 44, or a single radial shoulder 44 may be provided that is capable of engaging each of the feet 38. As the actuator 18 is inserted into its operative position in the access opening 26 of the casing 14, the tapered lower surface 42 of each retention leg 36 engages and slides over the radial shoulder 44, which forces the leg 36 to flex radially inwardly as the actuator 18 continues to be inserted through the access opening 26. After its foot 38 has slid past the radial shoulder 44, each retention leg 36 resiliently snaps back radially outwardly, causing its foot 38 to be captured within a recessed groove 46 below the radial shoulder 44. In this position, the tapered upper surfaces 40 of the feet 38 face and may engage the lower surface of the radial shoulder 44 to prevent the actuator 18 from freely exiting the access opening 26. In addition, a lower edge 48 of the recessed groove 46 faces and is capable of engaging the tapered lower surface 42 of each foot 38 to prevent the actuator 18 from sliding down farther into the interior cavity 12. The lower edge 48 is spaced axially apart (e.g., downwardly in the drawings) from the radial shoulder 44 a distance sufficient to allow the actuator 18 to travel a limited axial distance within the access opening 26, such as when the actuator 18 is depressed to actuate the spray valve 20 for releasing product from the cannister 16. In view of the above, the legs 36 and feet 38 of the actuator 18, the radial shoulder 44 of the casing 14, and the ability of the legs 36 to be deflected with the top wall 30 of the actuator 18 can be described as cooperating to provide a releasable retention mechanism for the actuator 18.

Figure 6A:
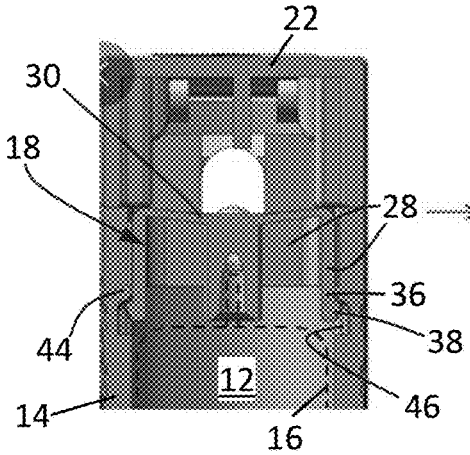
FIGS. 6A-6F are cross-sectional views along the lines A-A in FIG. 1 that illustrate several stages in the process of removing the cannister through the upper end of the dispenser.

When removing the cannister 16 from the casing 14, such as when desiring to insert a replacement cannister 16 into the interior cavity 12, the actuator 18 is adapted to be removed from the access opening 26 using steps such as represented by FIGS. 6A through 6F. In FIG. 6A, the actuator 18 is in the operative position with the feet 38 snapped into the recessed grooves 46 under the radial shoulders 44. The cannister 16 is disposed inside the interior cavity 12 with the valve stem of its dispensing valve 20 projecting into the receiver socket 34 of the actuator 18. The actuator 18 rests on the valve stem and there is a sufficient travel distance between the bottoms of the feet 38 and the lower edges 48 of the recessed grooves 46 to allow the actuator 18 to be depressed for actuating the dispensing valve 20. FIGS. 6B through 6F represent the actuator 18 being removed by rotating the flip-top safety 22, sufficiently flexing the retention legs 36 of the actuator 18 radially inward so that the feet 38 of the legs 36 are able to travel over and past the radial shoulder 44 of the casing 14, and then pulling the actuator 18 axially upward and out through the access opening 26.

To facilitate the process described above, the actuator 18 is structurally formed so that forcing its top wall 30 axially upward (FIGS. 6B and 6C) causes the top wall 30 to elastically deflect upward, which in turn causes the sidewall 28 and its legs 36 to elastically deflect radially inward (FIG. 6C) to an extent that the feet 38 of the legs 36 are able to travel past the radial shoulder 44 (FIG. 6D) with little or no interference from the radial shoulder 44. Once the feet 38 slide past the radial shoulder 44, the legs 36 automatically flex radially outwardly, and the actuator 18 can simply be slid out through the access opening 26 (FIGS. 6E and 6F). Thereafter, the cannister 16 can be removed from the casing 14 through the access opening 26, and a new cannister 16 can be inserted into the interior cavity 12 through the access opening 26.

Figure 6B:
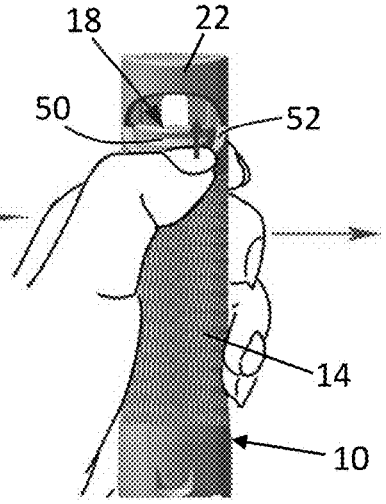
Figure 6C:
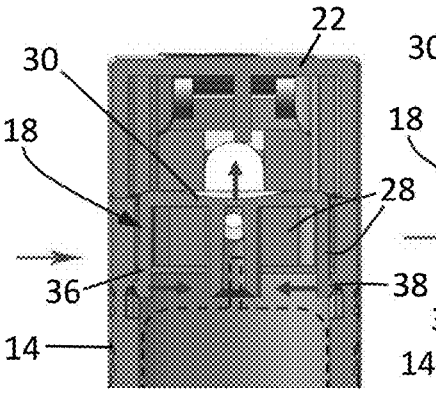
Figure 6D:
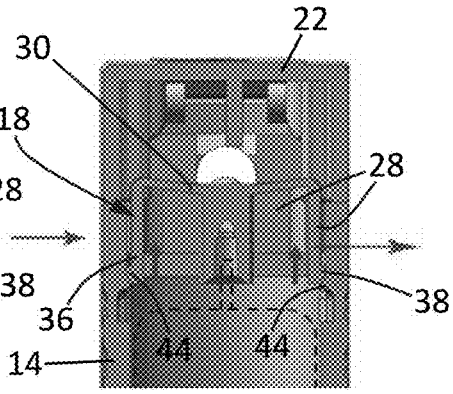
Figure 6E:
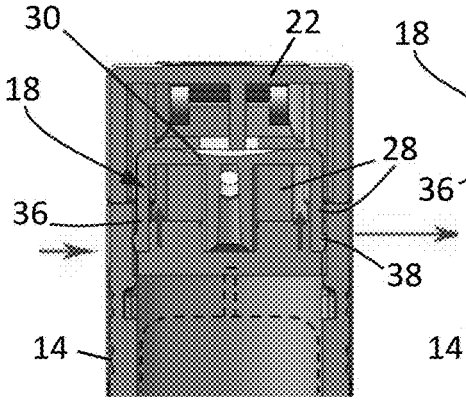
Figure 6F:
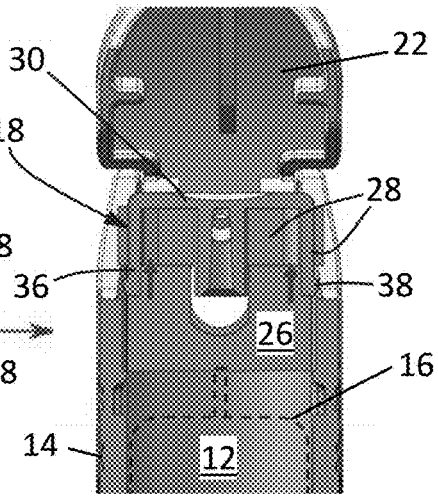

To further facilitate the process represented in FIGS. 6A through 6F, a radial slit 50 is defined in the actuator 18 so as to be accessible with a fingernail or thumbnail of a user (FIG. 6B). The radial slit 50 is recessed into the exterior of actuator 18 approximately where the top wall 30 adjoins the sidewall 28. As shown in FIG. 3, the actuator 18 and its slit 50 may be exposed by a scalloped recess 52 defined along a top edge of the casing 14, which in combination with the safety top 22 defines a cavity therebetween in which the actuator 18 is accessible for actuation with a finger or thumb. The radial slit 26 extends around a portion of the perimeter of the actuator 18, and is shaped and sized to receive a portion of the fingernail or thumbnail (or similarly sized instrument) of the user so the user can lift and deflect the top wall 30 upward as shown in FIG. 6B.

The angular slope of the tapered upper surfaces 40 of the feet 38 is particularly designed so that the radially inward deflection of the legs 36 and feet 38 of the actuator 18 induced by the axially upward deflection of the top wall 30 of the actuator 18 is sufficient to enable the feet 38 to readily slide over the radial shoulder 44 of the casing 14 without the need for excessive force that could damage the actuator 18 and/or radial shoulder 44. Slope angles of less than 20° risk such damage as a result of inhibiting the travel of the feet 38 over the radial shoulder 44 to the extent that excessive force must be exerted at the slit 50. On the other hand, slope angles exceeding 30° have been found to offer insufficient resistance, to the extent that the feet 38 of the legs 36 can be inadvertently caused to travel over and past the radial shoulder 44, thereby allowing the actuator 18 to be unintentionally displaced from the access opening 26 of the casing 14, leading to the possibility that the cannister 16 may inadvertently fall out of the cavity 12 of the casing 14.

It should be appreciated that the structural form and materials of the actuator 18 influence the removal of the actuator 18 from the access opening 26 of the casing 14. The drawings represent a nonlimiting embodiment in which the actuator 18 is formed of a plastic material and generally has the relative proportions represented in the drawings. However, such proportions can be readily tailored depending on the particular material from which the actuator 18 is fabricated.

In some optional embodiments, one or more axial guides may be provided at the interface between the outer radial surface of the sidewall 28 and the interior radial surface of the interior cavity 12 to ensure that the internal passage 19 of the actuator 18 is fluidically connected to the spray orifice 24 of the casing 14. Such an alignment feature can also be used to ensure that the legs 36 and feet 38 can be individually aligned with a corresponding radial shoulder 44. The axial guides may be formed by one or more axial tracks and guides and/or by complementary cross sectional shapes of the interior wall 32 of the casing 14 and actuator sidewall 28 that only allows the actuator 18 to be inserted into the interior cavity 12 in only a single orientation.

As previously noted above, though the foregoing detailed description describes certain aspects of one or more particular embodiments of the invention, alternatives could be adopted by one skilled in the art. For example, the dispenser and its components could differ in appearance and construction from the embodiments described herein and shown in the drawings, functions of certain components of the dispenser could be performed by components of different construction but capable of a similar (though not necessarily equivalent) function, and various materials could be used in the fabrication of the dispenser and/or its components. As such, and again as was previously noted, it should be understood that the invention is not necessarily limited to any particular embodiment described herein or illustrated in the drawings.

The invention claimed is:

1. A dispenser for spraying a chemical irritant, the dispenser comprising:

a casing having an upper end and a lower end disposed on a longitudinal axis of the casing, the casing having an interior cavity between the upper and lower ends and an access opening to the interior cavity disposed at the upper end of the casing, the interior cavity being configured to receive a cannister with a product release valve oriented toward the access opening in an operative configuration;

an actuator slidingly disposed in the access opening for actuating the product release valve; and a retention mechanism for releasably retaining the actuator in the access opening, the retention mechanism comprising:

a top wall and a sidewall of the actuator;

a resilient leg axially extending from the sidewall, the resilient leg having a foot extending radially outward from the resilient leg; and a radial shoulder extending radially inward from an interior wall of the interior cavity, the radial shoulder capturing the foot of the resilient leg so as to inhibit removal of the actuator from the access opening of the casing;

wherein the top wall of the actuator is operable to be deflected so as to cause the resilient leg to sufficiently deflect radially inward to enable the foot to travel over and past the radial shoulder and thereby allow the actuator to slide out through the access opening.

2. The dispenser of claim 1, wherein the foot has a tapered upper surface that faces the radial shoulder for engagement therewith.

3. The dispenser of claim 2, wherein the tapered upper surface slopes at an angle of about 20° to about 30° relative to a radial plane of the casing that is perpendicular to the longitudinal axis of the casing.

4. The dispenser of claim 1, the actuator comprising a slit recessed into an exterior thereof and operable to deflect the top wall of the actuator so as to cause the resilient leg to deflect radially inward.

5. The dispenser of claim 4, wherein the slit is sized and shaped to receive a fingernail or thumbnail therein.

6. The dispenser of claim 4, wherein the slit is aligned with a scalloped recess along a top edge of the casing adjacent the access opening.

7. The dispenser of claim 4, wherein the slit is disposed between the top wall and the sidewall of the actuator.

8. The dispenser of claim 1, further comprising a recessed groove in the interior wall adjacent the radial shoulder on an opposite side of the radial shoulder from the access opening, wherein the foot snaps into the recessed groove when the foot slides past the radial shoulder to retain the actuator in the access opening.

9. The dispenser of claim 8, further comprising a lower edge of the recessed groove that stops the actuator from sliding further into the interior cavity.

10. The dispenser of claim 9, wherein the lower edge is spaced axially from the radial shoulder to define a travel distance of the actuator that allows the actuator to selectively actuate the product release valve when disposed in the interior cavity.

11. The dispenser of claim 1, wherein the retention mechanism further comprises a second resilient leg axially extending from the sidewall, the second resilient leg having a second foot extending radially outward from the second resilient leg and operable to engage the radial shoulder or engage a second radial shoulder.

12. The dispenser of claim 1, further comprising a cannister disposed in the interior cavity, wherein the cannister contains a chemical irritant, and wherein the actuator is operatively disposed on a valve stem of the cannister.

13. The dispenser of claim 12, wherein the access opening is sized to allow the cannister to be inserted into the interior cavity through the access opening.

14. The dispenser of claim 12, wherein the actuator comprises a receiver socket for a valve stem of the cannister connected to a spray orifice.

15. The dispenser of claim 12, wherein the chemical irritant comprises at least one of pepper spray, pepper spray gel, and mace.

16. A method of removing a cannister from the dispenser of claim 1, the method comprising:

deflecting the top wall of the actuator to cause the resilient leg to sufficiently deflect radially inward to enable the foot to travel over and past the radial shoulder;

removing the actuator through the access opening; and sliding the cannister out of the interior cavity through the access opening.

17. The method of claim 16, wherein the deflecting of the top wall of the actuator comprises engaging a thumbnail or fingernail into a slit recessed into an exterior of the actuator.

* * * * *